United States Patent [19]

Elder

[11] Patent Number: 4,696,469

[45] Date of Patent: Sep. 29, 1987

[54] HAMSTRING MUSCLE EXERCISER

[76] Inventor: Michael G. Elder, 106 N. Spruce, Goddard, Kans. 67052

[21] Appl. No.: 820,131

[22] Filed: Jan. 21, 1986

[51] Int. Cl.[4] ..... A63B 21/00

[52] U.S. Cl. ..... 272/134; 272/117; 272/144

[58] Field of Search ..... 272/93, 116, 117, 118, 272/123, 134, 143, 144, 145; 128/25 R

[56] References Cited

U.S. PATENT DOCUMENTS

| | | | |
|---|---|---|---|
| 3,089,700 | 5/1963 | Hotas | 272/117 |
| 4,369,966 | 1/1983 | Silberman et al. | 272/117 |
| 4,487,199 | 12/1984 | Saringer | 128/25 R |
| 4,509,746 | 4/1985 | Mask | 272/134 |
| 4,546,968 | 10/1985 | Silberman | 272/117 |
| 4,632,393 | 12/1986 | Van Noord | 272/134 |

*Primary Examiner*—Richard J. Apley

*Assistant Examiner*—J. Welsh

*Attorney, Agent, or Firm*—Kokjer, Kircher, Bradley, Wharton, Bowman & Johnson

[57] ABSTRACT

An exercise apparatus in the form of a bench having an L-shaped lever pivoted to the bench for swinging by the user. An adjustable weight is fastened to the lever at selectively variable locations from the pivot point for wide variations in the available resistance to exercise movements involving exercise of the hamstring muscles without undue involvement of other muscle groups. A lost motion device operable by the swinging of the lever maintains the amplitude of the exercise movement within widely adjustable limits to assist in involving primarily the hamstring muscles during the use of the apparatus. The bench pad may be covered with a fabric which is relatively resistant to the build-up of static electricity to minimize involuntary muscle stimulation when contacted by the user.

9 Claims, 5 Drawing Figures

HAMSTRING MUSCLE EXERCISER

This invention relates to exercise apparatus, and more particularly to apparatus especially suited for providing exercise for the hamstring muscle of the human body.

The importance of the hamstring muscles to good body conditioning is well known and has received relatively widespread attention due to injuries affecting these muscles suffered by athletes involved in professional and amateur competitive athletics. The hamstring muscles flex the leg upon the thigh. If the tibia bone is fixed, these muscles support the pelvis on the femur. These muscles are the ones called upon to throw the body backward in an arch. They may be called upon to draw the trunk backward.

It will be readily apparent that the foregoing movements are often involved in some manner or another in the ordinary movements of the body in day to day activities and are certainly involved in relatively active, often violent sports activities. The frequency of injuries involving these muscles has caused physiologists, and particularly those involved in sports medicine and body conditioning, to become especially aware of the importance of exercising and proper conditioning of the hamstring muscles.

Relatively recently it has been discovered that conventional techniques are deficient in providing the appropriate exercise for these muscles. Due to the construction of the human body, and more particularly to the location of the hamstring muscles relative to that of other, more dominating muscles, the benefits of exercising usually inures to the more dominant muscles or muscle groups. As a consequence, the hamstrings do not derive the benefit needed.

Studies have indicated that the conventional knee or leg exercise bench involving an arm or lever which is moved by the leg against a weight or resistance often provides little or no benefit to the hamstring muscles. If the weight (or resistance) is lifted too high, or if the exerciser exceeds the limits of his hamstring muscles in the exercise, the other involved muscle groups tend to dominate the exercise movement. This involvement of the other muscle groups changes the electrical activity of such muscle groups, thereby changing the work done by each muscle group. The more dominant muscle groups do most of the work of the exercise and the hamstring muscles suffer by not being properly conditioned.

In order to carry out exercises to improve the hamstring muscles, these muscles must be effectively "isolated" from the other groups which would tend to dominate the exercise. It has been discovered that effective hamstring muscle isolation for conditioning during exercise can be effected if the articulation at the knee joint is limited to appropriate parameters and if the resistance or weight moved by the muscle is kept to proper limits. These parameters of limitation, in order to effectively isolate the work of the hamstring muscles, will vary from individual to individual. Thus, appropriate exercise apparatus for conditioning these muscles should be capable of careful adjustment to provide limits calculated to permit the hamstrings to be properly exercised without undue involvement of other muscles or muscle groups which would deprive the hamstring muscles of the intended work. The studies have indicated that muscles such as the quadriceps, vastus lateralis, adductor magnes and gastroc usually are brought into action during leg exercise routines involving conventional exercise equipment. These muscle groups so completely dominate the leg movement that they do not permit proper conditioning of the hamstring muscles.

Accordingly, it is a primary object of the present invention to provide apparatus particularly adapted for conditioning the hamstring muscles.

In the achievement of the foregoing object, it is also an important object of the present invention to provide apparatus wherein the stroke of the leg exercise may be readily limited to that calculated to isolate the hamstring muscles during the exercise, thereby insuring that a major portion of the work is performed by those muscles and not by more dominant muscle groups.

Another very important object of this invention is to provide such an exercise apparatus wherein the quantity of the force required in the leg exercise movement may be readily adjusted in a wide variety of increments to permit hamstring muscle isolation during the exercise.

A further object of the invention is to provide such apparatus wherein all of the critical exercise parameters are quickly and easily adjustable to accommodate the limits determined empirically for proper hamstring exercise for a particular user.

Yet another object of the present invention is to provide such exercise apparatus having a padded support for the body and wherein the material covering the pad is of a type which does not tend to interfere with the involvement of the desired muscles by electrostatic or other sensation stimulation of the muscles.

These and other important aims and objectives of the present invention will be further explained or will become apparent from the following description and explanation of the figures of the drawings, wherein.

Figure 1:
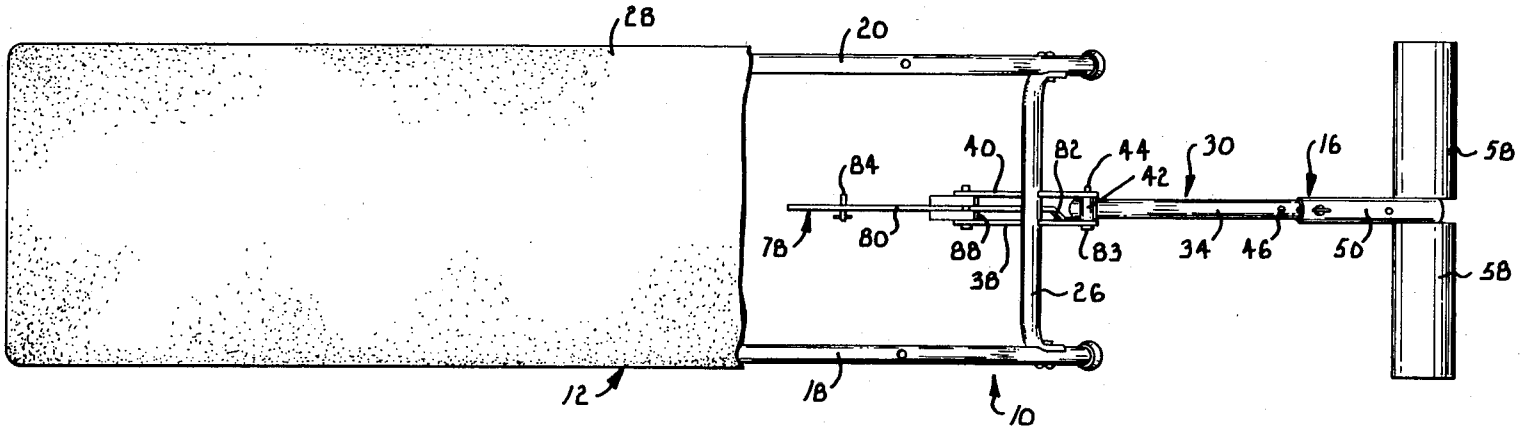
FIG. 1 is a top plan view of exercise apparatus embodying the principles of this invention, parts being broken away to reveal details of construction.

Apparatus embodying the principles of this invention is broadly designated by the reference numeral 10 and includes a table 12 for supporting the human body while using the apparatus in an elevated position above a floor or surface 14, and a member 16 adapted to be articulated by the user during the exercise routine. Table 10 includes a pair of substantially parallel, elongated, tubular elements 18 and 20. Each of the elements is bent into general U-shaped configuration as illustrated best in FIG. 2 of the drawing so that each element provides a substantially vertical leg 22 for one end of the table and an outwardly angled leg 24 at the opposite end of the table proximal the location of the articulated member 16.

The U-shaped elements 18 and 20 are substantially identical and are rigidly secured together at each end by respective U-shaped, tubular cross members 26 best illustrated in FIG. 1 of the drawing. The respective cross members are rigidly secured to and interconnect the spaced apart pairs of legs 24 and 22 respectively.

The elements 18 and 20 provide supporting leg structure for a pad 28 forming the body supporting surface for the table. Table 28 is of appropriate dimensions for supporting the human body in a reclining position for carrying out the exercise routine using apparatus 10 as will be subsequently more fully explained.

The articulated member 16 is mounted on the end of table 12 which is supported by the outwardly angled legs 24. Member 16 includes an elongated, substantially L-shaped, tubular crank or lever 30 having a pair of integrally interconnected lever arms 32 and 34 respectively. The angle of the legs 24 from vertical minimizes any tendency for the table to tip due to the cantilevering of the weight associated with member 16 beyond the end of the table.

Figure 2:
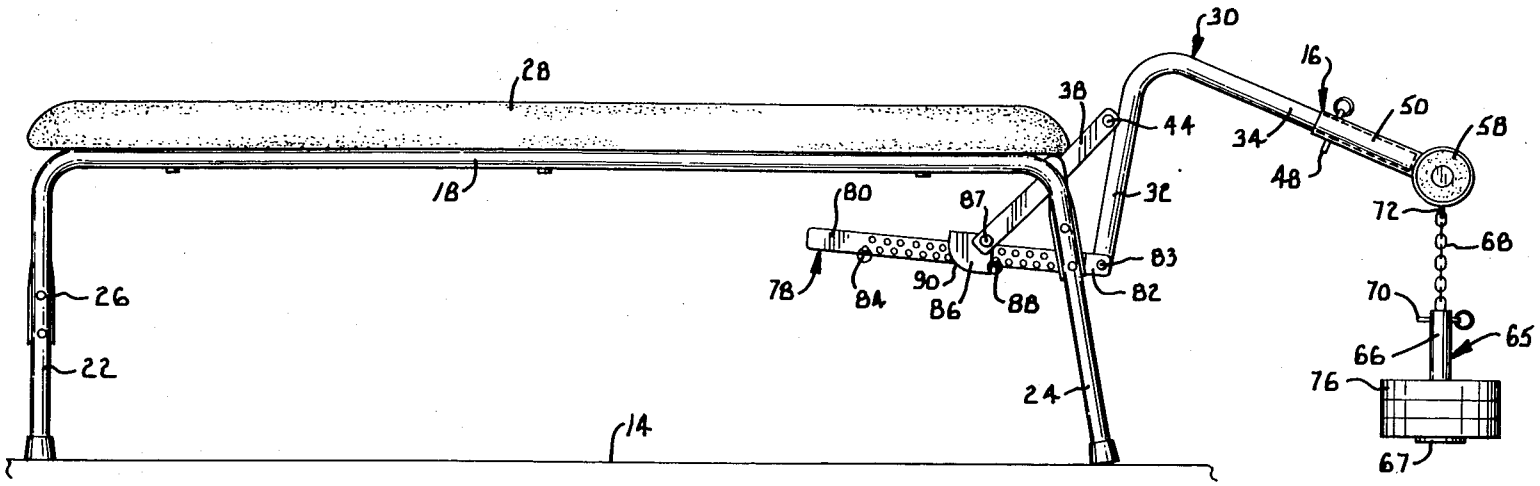
FIG. 2 is a side elevational view thereof.
Figure 5:
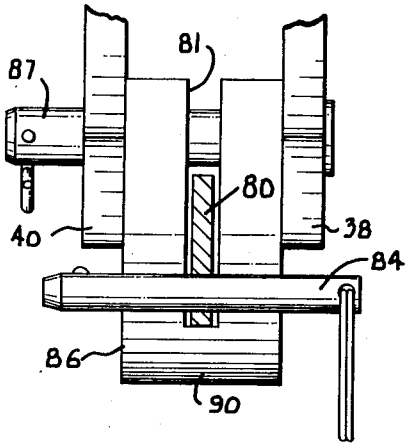
FIG. 5 is a still further enlarged, detailed cross-sectional view taken along line 5—5 of FIG. 3.
Figure 4:
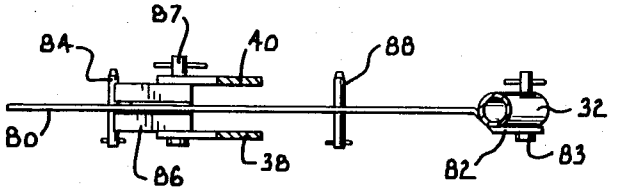
FIG. 4 is a detailed cross-sectional view taken along line 4—4 of FIG. 3, parts being broken away to reveal details of construction.

Means for pivotally mounting member 16 to table 12 include a pair of elongated, parallel, spaced apart, rigid straps 38 and 40, each being rigidly secured intermediate their ends by welding or the like to the proximal cross member 26 centrally of the latter and directed upwardly and outwardly as illustrated in FIG. 2. A tubular hinge member 42 is welded to leg 32 of lever 30 and is pivotally attached to the straps 38 and 40 by a pin 44 received through member 42 and aligned holes in the straps so that the lever may be swung about a horizontal axis defined by pin 44.

Figure 3:
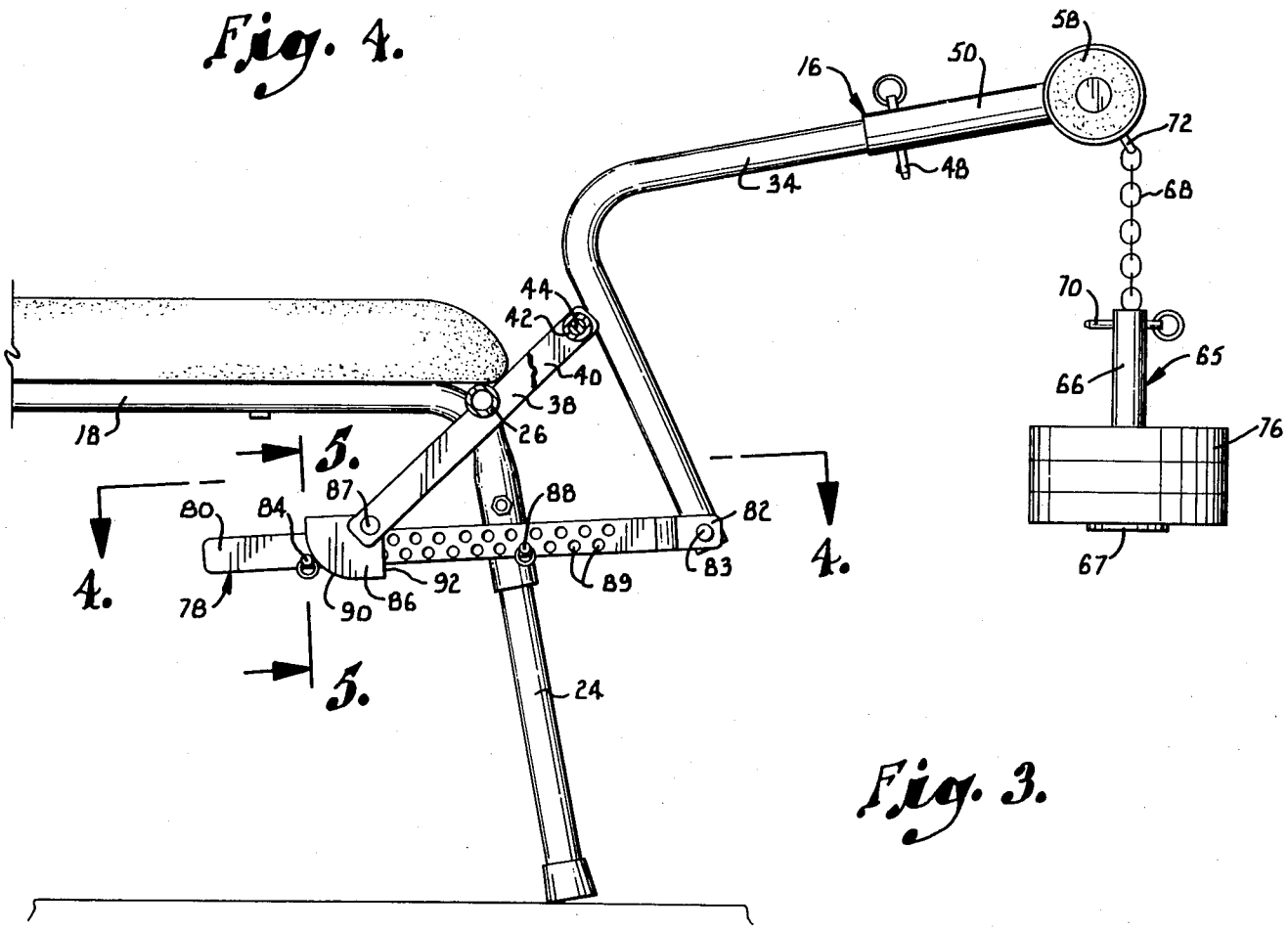
FIG. 3 is an enlarged, fragmentary view similar to FIG. 2 but showing the articulating member in a raised position, parts being broken away and shown in cross-section to reveal details of construction.

A substantial length of the outer end of arm 34 of lever 30 is provided with a series of spaced apart holes 46 to receive therethrough a pin 48 extending transversely through an elongated, rigid tubular slide 50 received in telescoped relationship over the outer end of arm 34 as shown in FIGS. 1, 2 and 3 of the drawing. Manifestly, the effective length of arm 34 can be extended or shortened as desired by adjusting the amount by which slide 50 projects from the end of arm 34. This projecting length is, of course, variable depending upon which of the holes 46 may be chosen to receive the coupling pin 48.

Means adapted to be engaged by the user of the apparatus for articulating lever 30 about its hinge comprises An elongated, rigid cross bar 54 rigidly secured to the outer end of 50. Preferably, tubular cushions 58 of resilient material are received in telescoped relationship over each crossbar.

Means for providing resistance to the articulation of member 16 by the user of the apparatus in carrying out exercise routines particularly directed to the conditioning of the hamstring muscles is provided in the form of a weight which opposes upward pivoting of lever arm 34. Accordingly, a weight holder 65 comprising an elongated, tubular shaft 66 integral with bottom disc 67 is carried at the outer end of slide 50 by means of a flexible chain 68. One end of the chain is secured to the upper end of shaft 66 by a removable pin 70 and the other end of the chain is received over a hook 72 carried by slide 50 and depending therefrom. Any selected number of a plurality of conventional, centrally apertured, disc-like incremental weight elements 76 may be telescoped over the tubular shaft 66 and supported by disc 67 to impart the desired resistance against upward articulation of lever 30.

The effective resistance to the upward movement of lever 30 depends on the amount of weight carried by holder 65 and also the distance between the point of attachment of the weight to the lever and the axis of pivotal attachment of the lever to the table. The greater the distance, the larger the resistance. Since this distance and the amount of the weight may both be adjusted in relatively small increments between wide limits, the effective resistance is very highly adjustable to meet the precise requirements prescribed for a particular user.

Means to limit the stroke of articulation of the lever is provided in the form of a lost motion device 78 attached to lever arm 32. Device 78 includes an elongated, rigid bar 80 bent at one end into an offset 82 for pivotal attachment by a pin 83 to the lower end of arm 32. Bar 80 is slidably received in an upwardly opening notch 81 in a body 86 which is pivotally secured to the lowermost ends of the straps 38 and 40 by a pin 87. Body 86 is preferably formed from a synthetic resin material such as nylon, Debrin or the like having a relatively low coefficient of friction and good wearing characteristics. Body 86 provides a guide in which bar 80 slides back and forth during use of the exercise apparatus. The plastic material not only minimizes the wear on the relatively moving parts, but it also minimizes any objectionable noise which could otherwise result from such movement.

The pivotal attachment of guide 86 to the straps 38 and 40 permits the guide to swing to the position required for the bottom of notch 81 to remain parallel with bar 80 regardless of the up and down movement of the end of the bar pinned to the end of leg 32 as the latter is swung about the axis of pin 44 by the user. The limit of such swing is defined by spaced apart, removable pins 84 and 88 which may be positioned in any selected ones of the holes 89 extending transversely through bar 80. Referring particularly to FIG. 3, the holes 89 are preferably arranged in two longitudinally extending, relatively offset series of spaced apart holes whereby the precise positioning of the pins 84 and 88 along the bar can be effected within relatively narrow limits. The pins 84 and 88 serve as stops to define the limits of relative movement between the bar and body 86. This relative movement defines the limit of permitted swing for member 16. Limiting this swing during exercise is extremely important to the achievement of the overall goal of isolating the hamstring muscles for proper conditioning during use of the apparatus.

It should be pointed out at this juncture that the edge 90 of the plastic slide or body 86 proximal pin 84 is arcuate. In the preferred embodiment, edge 90 is generally concentric with pin 88. This arcuate edge provides a gentle, rather than an abrupt stop for the upward movement of member 16 when pin 88 moves into engagement with slide 86 at the forward end of the path of travel of bar 80. This gentle stop for the upward swinging of member 16 serves to minimize the chance for injury to a user which could occur from impact at the end of the exercise stroke. This feature is particularly important in situations where apparatus 10 is used in therapy exercise programs for patients who have suffered hamstring muscle injury or injuries of other types.

While the positioning of pin 88 relative to pin 84 is important to define the limits of extent of the exercise stroke, pin 88 may be permitted to impact against the forward or straight edge 92 of slide 86. This impact occurs on the downward swing of member 16 by gravity and no adverse result enures to the patient from such impact.

In operation, a user who desires to strengthen or condition the hamstring muscles may follow a routine of short arc curls performed through use of apparatus 10. Thus, the user would typically lie face down on pad 28 of table 12 with his legs projecting from the end of the table proximal member 16. Slide 50 is adjusted longitudinally of arm 34 to the proper position for engagement of the cushions 58 by the leg of the user in the heel region. The curls are accomplished by the articulation of the users legs to swing the lever 16 upwardly in an arc about its point of pivotal attachment to the table and against the weight hanging from hook 72. Obviously, the user may exercise each leg individually or may exercise both simultaneously in accordance with whatever routine has been prescribed by the physician or physical therapist administering the exercise program for the particular user.

As heretofore pointed out, the dominant muscle groups, other than the hamstring muscles, involved in body movement and particularly in leg movement, tend to take over such movement to the exclusion of the hamstring muscles unless carefully controlled parameters are observed. These muscle groups overshadow the hamstring muscles unless the amount of resistance to the leg movement is carefully kept within prescribed limits wherein the hamstring muscles may be exercised without substantial involvement of the more dominant muscle groups. Further, even when such resistance limits are observed, the stroke of the movement involving the hamstring muscles must be kept within certain limits if the more dominant muscle groups are to be left uninvolved.

The precise parameters for both resistance and stroke to achieve optimum results and to maintain relative isolation of the hamstring muscles during the exercise vary from individual to individual. It is not possible to prescribe these parameters with which to achieve the beneficial hamstring conditioning results in a generalized manner. Rather, they must be determined empirically and in accordance with a carefully controlled and knowledgeable exercise routine. It suffices to say, however, that apparatus 10 provides the adjustability in both the position and magnitude of the weight required so that the resistance of the exercise can be suitable for accommodating the requirements of users varying from relatively small children to much larger adult athletes.

It will be readily understood that bar 80 is reciprocated back and forth relative to guide 86 during each arcuate swing of member 16 responsive to the exercise routine. The amplitude and the location of the stroke permitted during the routine can be adjusted to whatever length and position desired within the limits afforded by the length of the series of holes in bar 80, simply positioning the pins 84 and 88 at the preselected locations. A user can normally very readily determine the position during the stroke at which the more dominant muscles tend to take over the body movement from the hamstring muscles. He can readily adjust the stroke of the exercise routine with apparatus 10 to limit the movement to that just short of this point. Here again, the precise length of stroke cannot be predetermined without reference to the particular user involved. Apparatus 10 is particularly well suited to accommodate the exercise strokes required for all users ranging from the small, relatively weak exerciser to more powerful adults.

Weight holder 65 affords wide selectability in the amount of resistance available to the exercise movements during the use of apparatus 10. The importance of matching appropriate resistance precisely with that necessary for hamstring involvement, to the exclusion of other muscle groups, is such that it is desirable to provide considerable precision of resistance for certain users. Weights of sufficiently small increments should be chosen for this purpose. The weights 76 are for illustrative purposes only and each weight shown may not be sufficiently small to accomplish the degree of selectivity required in a given case.

Recent studies have indicated that certain materials, when contacted by the human body may produce a stimulation resulting in some manner of involuntary muscle activation. It is believed that this phenomenon may be related to static electricity since some kinds of materials produce this phenomenon when contacted by the human skin while other types of materials are relatively inert in the sense of producing very little such muscle stimulation. It is currently thought that the stimulation may result from some type of electrical transfer between the contacting material and receptors in the human skin.

In order the maximize the conditioning of the hamstring muscles and to the minimize the involvement of other muscle groups, this phenomenon can reasonably be taken into consideration. Accordingly, the material chosen for the covering for the pad 28 should be of a type which is considered relatively "inert" with respect to the production of this phenomenon. In the presently preferred construction of apparatus 10, it is considered that any of a number of relatively strong commercially available materials which exhibit the property of preventing or minimizing the build-up of static electricity on the material would be suitable for the pad covering. One such fabric is commercialized by Herculite Products, Inc., 1107 Broadway, New York, N.Y. 10010, under the trademark ANSTAT.

Having thus described the invention, I claim:

1. Apparatus for exercising the hamstring muscles of the human body, said apparatus comprising:

means for supporting the body in position for articulating the knee joint;

lever means pivotally coupled with the supporting means and including leg engageable means carried by the lever means and adapted to be engaged by the users leg below the knee for swinging of the lever through a vertical arc during said articulation of the knee joint;

means biasing the lever toward the lowermost end of its path of travel, said biasing means being yieldable under the influence of force exerted through the user's leg utilizing hamstring muscles to articulate the knee joint and thereby swing the lever through said arc;

means operably coupled with the support and with the lever respectively for limiting the arc of swing of the lever, said limiting means and said biasing means each being individually adjustable; and said limiting means including an adjustable means for limiting both the upper and lower directional limits of the arc swing of the lever as to limit the length of the exercising stroke to that for which will involve substantially only the hamstring muscles in the swinging of the lever by the user during articulation of the knee joint.

2. Apparatus as set forth in claim 1, wherein:

said supporting means includes a generally planar table leg means including for supporting the table in a generally horizontal disposition in vertically spaced relationship above a supporting surface;

said lever means comprising a generally L-shaped, rigid crank having a pair of interconnected crank arms, one of said arms being pivotally connected to said table for swinging in a vertical arc, said other arm projecting outwardly from the table;

said leg engageable means including a member adjustable secured to said other arm and projecting therefrom; and wherein the biasing means includes a weight secured to said other arm in outwardly spaced relationship from the point of pivot of said one arm to the table, whereby the weight urges the lever to the lowermost end of its path of travel.

3. Apparatus as set forth in claim 2, wherein:

said swing limiting means includes a lost motion device carried by said table, said device including a fixed element, an eleent movable with respect to the fixed element, and said adjustable means for varying the extent of movement permitted between the respective elements; and means pivotally coupling the movable element to said one arm of the lever in outwardly spaced relationship from the point of coupling of said one arm to the table, whereby the swinging of said lever with respect to the table moves the movable element to the extent permitted by said adjustable means.

4. Apparatus as set forth in claim 3, wherein said lost motion device includes:

a guide secured in fixed position relative to the table, said guide having an opening therethrough;

an elongated bar extending through the guide opening in sliding relationship with the guide, one end of the bar being pivotally coupled to said one arm of the lever for longitudinal sliding movement of the bar responsive to swinging of the lever; and a pair of stops carried by the bar, there being a stop on each side of the guide, each stop being engageable with the guide for conjointly limiting sliding movement of the bar in both directions; and the positions of the respective stops being selectively adjustable along the bar, whereby to vary the extent of swinging movement of the lever.

5. Apparatus as set forth in claim 2, wherein said leg engageable member is slidably mounted on said other arm of the lever, and wherein is included means releasably securing the member at any predetermined position along the member to permit selective varying of the position of the member along the lever arm relative to the point of coupling of the lever to the table.

6. Apparatus as set forth in claim 5, wherein said member includes a tube telescoped over said other arm of the lever for sliding movement along the latter, there being a crossbar extending outwardly in opposite directions from the tube, and wherein is included means for releasably securing the tube in any of a variety of predetermined locations longitudinally of the lever arm.

7. Apparatus as set forth in claim 6, wherein said biasing means includes a weight, and a flexible element securing the weight to said tube.

8. Apparatus as set forth in claim 7, wherein said weight includes a weight holder secured to the element, and a plurality of incremental weight elements removably carried by the holder, each element being individually removable from the holder to selectively vary the biasing force on said lever.

9. Apparatus as set forth in claim 1, wherein said body support means includes a generally horizontal bench having a pad thereon, and wherein the upper surface of said pad is covered with a fabric having the property of minimizing the build-up of static electricity on the material.

* * * * *